United States Patent [19]

Roestenberg

[11] Patent Number: 4,811,526

[45] Date of Patent: Mar. 14, 1989

[54] STORABLE WATER CURTAIN SANDING AIR SYSTEM

[76] Inventor: Jerome R. Roestenberg, 11 Woodpecker Ln., Levittown, N.Y. 11756

[21] Appl. No.: 58,081

[22] Filed: Jun. 4, 1987

[51] Int. Cl.[4] ..... B24B 55/00

[52] U.S. Cl. ..... 51/270; 210/167; 51/266

[58] Field of Search ..... 51/270, 262 R, 268, 51/266; 134/10; 210/167

[56] References Cited

U.S. PATENT DOCUMENTS

| | | | |
|---|---|---|---|
| 1,773,374 | 8/1930 | Ruemelin . | |
| 3,239,438 | 3/1966 | Voorhees | 210/167 |
| 3,389,797 | 6/1968 | Giardini | 210/167 |
| 3,450,266 | 6/1969 | Allen | 210/167 |
| 4,121,388 | 10/1978 | Wilson . | |
| 4,232,487 | 11/1980 | Brown . | |
| 4,300,318 | 11/1981 | Brown . | |
| 4,537,639 | 8/1985 | Shook | 134/10 |

*Primary Examiner*—Roscoe V. Parker

*Attorney, Agent, or Firm*—Nolte, Nolte and Hunter

[57] ABSTRACT

A storable water curtain sanding aid system for use with a work surface undergoing sanding, which includes filter for separating water from particulate matter, and a tray that is easy to deploy under the work surface and one of which the unused portion can be stored during the sanding operation. Spigots in a support frame for attaching to a vehicle, supply water to the work surface. The water is caught in the tray and delivered, with particulate matter from the work surface, by a pump to the filter, and water again from the filter to the spigots. The tray includes a plurality of frames along its length which contriubute to its stability and form, and aid in folding during storage. An erection pivot mounted on the frame biases the frame to an upright position when it is drawn from storage. In a preferred embodiment it is fastened to the tray bottom and biases vertical frame sections by way of a bottom frame section. In another embodiment the erection pivot is mounted on a top frame section and rotates with the aid of a fold shield upon deployment of the tray, so that it bears on the tray bottom for aid in side support.

24 Claims, 5 Drawing Sheets

FIG. 3
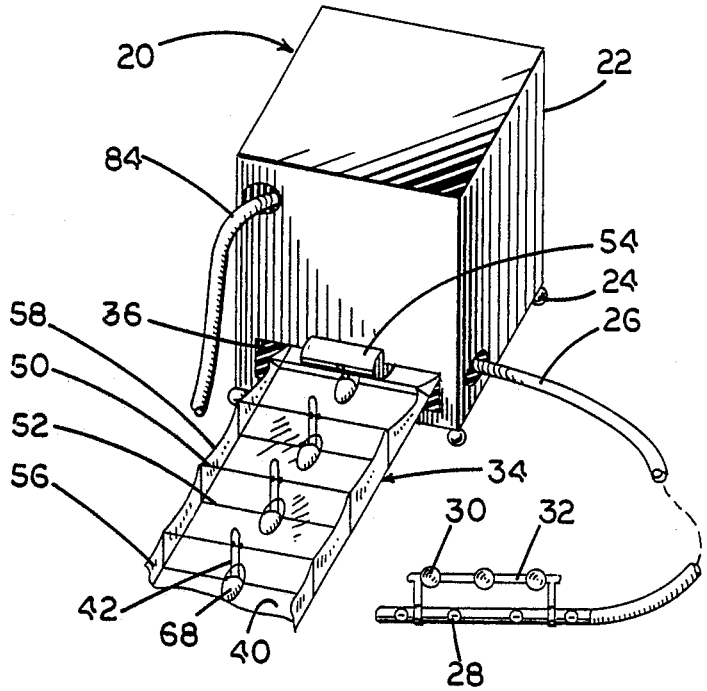
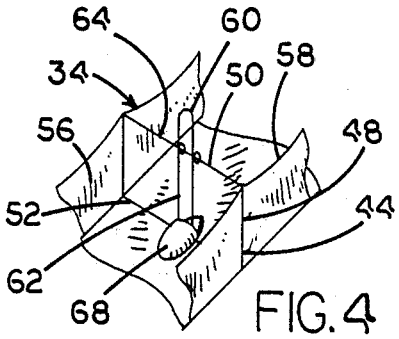
FIG. 4
FIG. 5
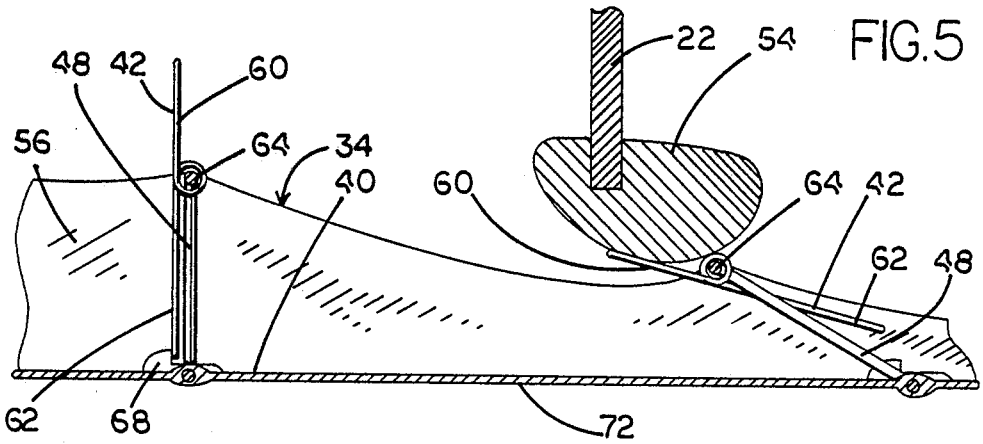

FIG. 6
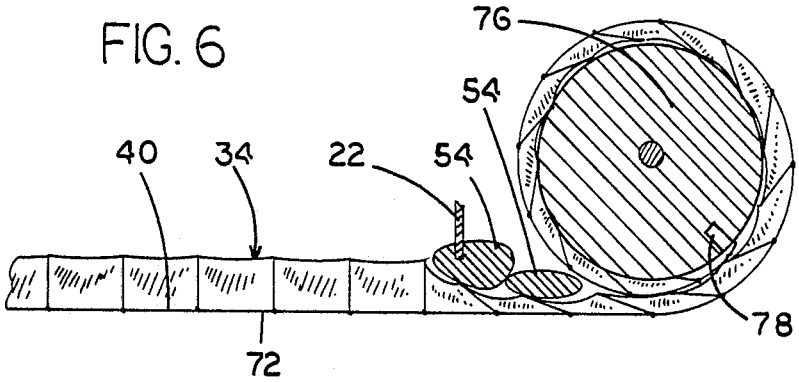
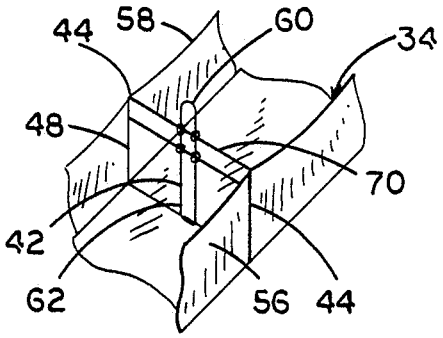
FIG. 7A
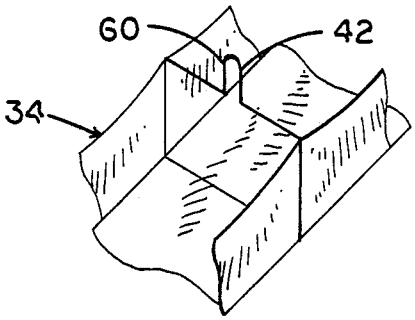
FIG. 7B
FIG. 8B
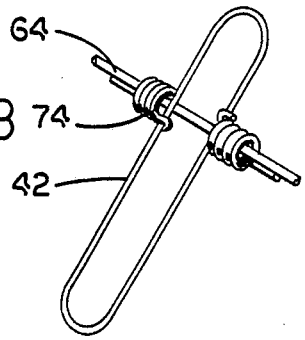
FIG. 9
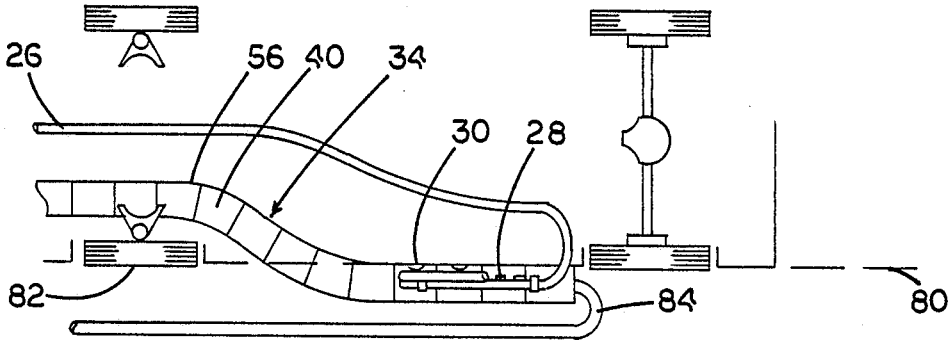

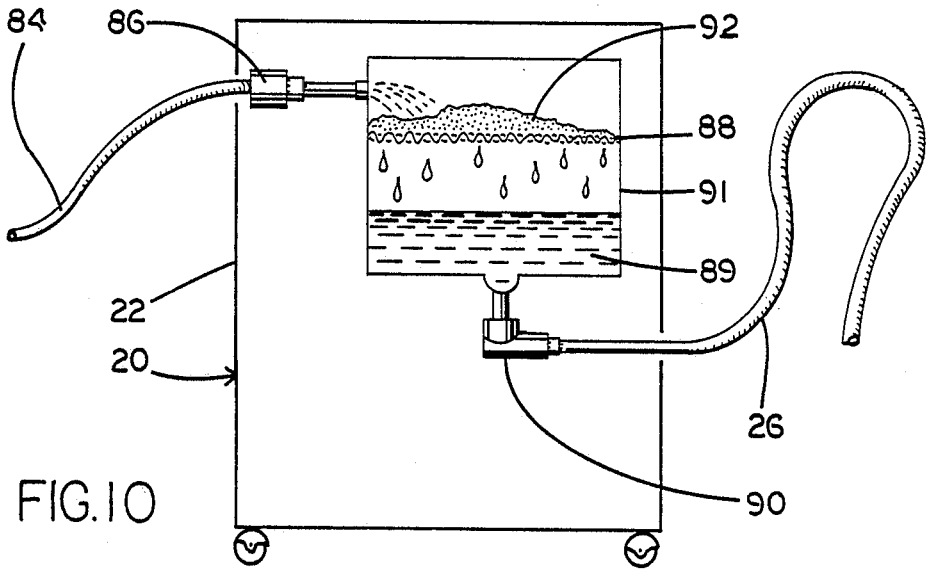
FIG. 10
FIG. 12
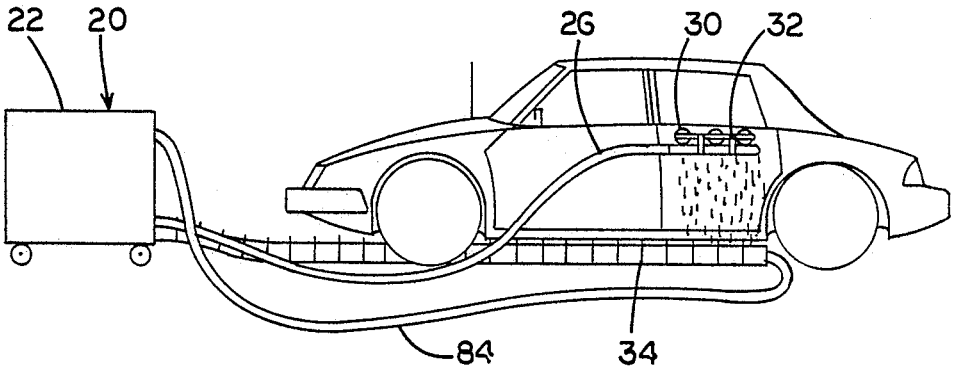

STORABLE WATER CURTAIN SANDING AIR SYSTEM

BACKGROUND OF THE INVENTION

1. Field of the Invention

The present invention relates in general to material dispensing and collection, more specifically to a water curtain sanding aid system with storable retrieval tray for use with sanding of vehicle body surfaces.

2. Description of the Prior Art

Presently, in the vehicle body restoration trade, sanding of vehicle panel surfaces is often accompanied by constant wetting of the work surface with water. This water curtain is advisable because it helps to avoid airborne paint and grit contamination that is unhealthy and that has a detrimental effect upon painting.

The operation is usually carried out by simply attaching a hose to the vehicle frame over the work area and allowing water to run over the work surface, carrying with it the grit and other particulate matter such as paint chips which result from the sanding operation. The resulting water and particulate matter sludge is allowed to run on the work area floor, and across it to the drain and local sewer system. This not only presents a work hazard and an environment that causes contamination of follow-on work, but it pollutes the sewer system with paint and primer particulates, and wastes water.

Occasionally a pan is positioned under the work surface to collect the water and above pollutants The pan, when filled however, is heavy and difficult to move and to empty. It is usually emptied down the drain.

SUMMARY OF THE INVENTION

It is one object of the invention to provide a storable water curtain sanding aid system that permits reuse of the curtain water.

It is another object of the invention to provide a storable water curtain sanding aid system that provides for easy collection of particulate matter resulting from the work, without having to move an accompanying heavy body of water.

Another object of the invention is to reduce unhealthy air contamination resulting from sanding.

Another object is to reduce contamination of the work area which has a detrimental effect upon work that follows sanding.

Another object is to provide a storable water curtain sanding aid system that has a tray which is easy to deploy under the work surface and which can store part or all of the tray not being used for collecting.

In accordance with the present invention, there is provided a water curtain sanding aid system with storable collection tray that is used in conjunction with a work surface, preferably in vehicle body sanding operations.

A spigot support frame held by suction cups, magnets or other means, is attached to the vehicle body, above the surface to be sanded. The frame contains spigots for delivering water over the work surface. A tray is located under the work surface for collecting the water from the spigots and particulate matter shed from the work surface. One end of the tray is attached to a take-up roll mounted on or within a support body such as a housing. The tray is drawn up on the roll, its sides collapsing or nesting as it accumulates on the roll, while the remaining portion of the tray is used for collecting.

In typical use, the operator sands the vehicle's surface with a sanding block while the spigots deliver water to the work area. The water flushes sanding media particles and sanding dust from the sanded surface while it helps to unclog the sand paper and minimizes generation of airborne sanding dust. The tray is located under the work surface and coextensive with it. The tray's side wall that is closest to the operator is forward of the work surface, and the side wall that is further from the operator is rearward of the work surface. This arrangement collects most of the falling water and sludge comprising water, dust and sanding media. A flexible shield or bib attached to the inboard surface of the further wall, and to the back side of the panel having the surface being sanded, assures collection of most of the water that is deflected by the sanding block, the operator's hand, and that which follows the surface contour of the panel being sanded to a location that is not directly over the tray.

The tray includes a plurality of frames along its length which contribute to its stability and form, and aid in folding during storage. An erection pivot mounted on the frame biases the frame to an upright position when it is drawn from storage. In a preferred embodiment, the erection pivot is fastened to the tray bottom and biases vertical frame sections by way of a bottom frame section. In another embodiment, the erection pivot is mounted on a top frame section and rotates with aid of a fold shield to a supporting position in which one end bears on a stop located on the tray's bottom for holding the tray side walls in an erect status with respect to the tray's bottom.

Ducting is provided to move tee water and entrained sludge to a filter, and to move the filtered water to the spigots. One or more pumps move the water and sludge through the ducting. Sludge may be removed from the filter for easy and safe discarding.

In another embodiment, the tray comprises self supporting sides, portions for forming it under the work surface, for example around a vehicle wheel or under a wheel well, and it may also include a flexible shield or bib along a portion of its length for attaching to parts of the vehicle. Attaching may be accomplished by magnets, clips or elastic portions on the shield.

BRIEF DESCRIPTION OF THE DRAWINGS

The invention will now be described with respect to drawings, so that it may be more clearly understood. In the drawings, like parts carry like numbers.

FIG. 3 a schematic view of another embodiment of the invention.

FIG. 4 is a perspective view of a portion of a tray, showing a cammed erection pivot.

FIG. 5 is a perspective view of a portion of a tray, showing one type of spring loaded erection pivot.

FIG. 6 is a partial cross sectional view through a cam stop and fold shield.

FIG. 7A is a perspective view of a portion of a tray, showing another type of spring loaded erection pivot, and FIG. 7B shows a shortened erection pivot.

FIG.'s 8A and 8B are schematic views of two types of coil spring loaded erection pivots.

FIG. 9 is a top schematic view of a tray deployed around a vehicle wheel and under a work surface.

FIG. 10 a schematic representation of a filtering and pumping arrangement in the invention.

Figure 11:
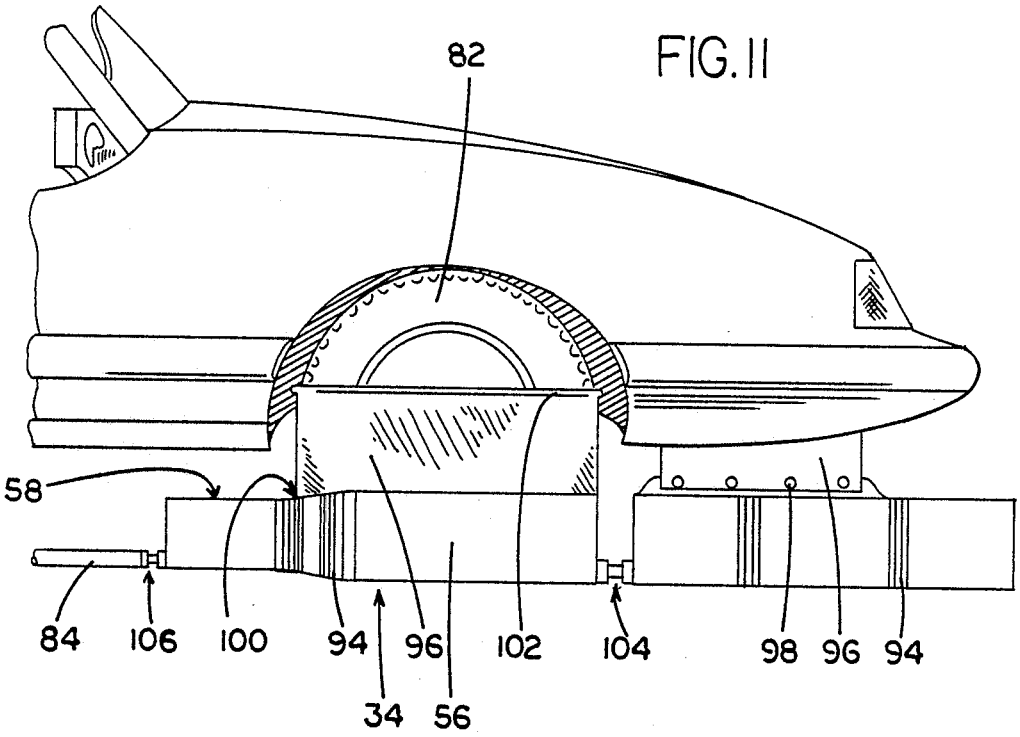

FIG. 11 is a perspective view of another tray according to the invention, including a flexible portion and two types of shields.

FIG. 12 is a schematic view of the invention attached to a car for use with sanding of its rear door panel.

DESCRIPTION OF THE PREFERRED EMBODIMENTS

Figure 1:
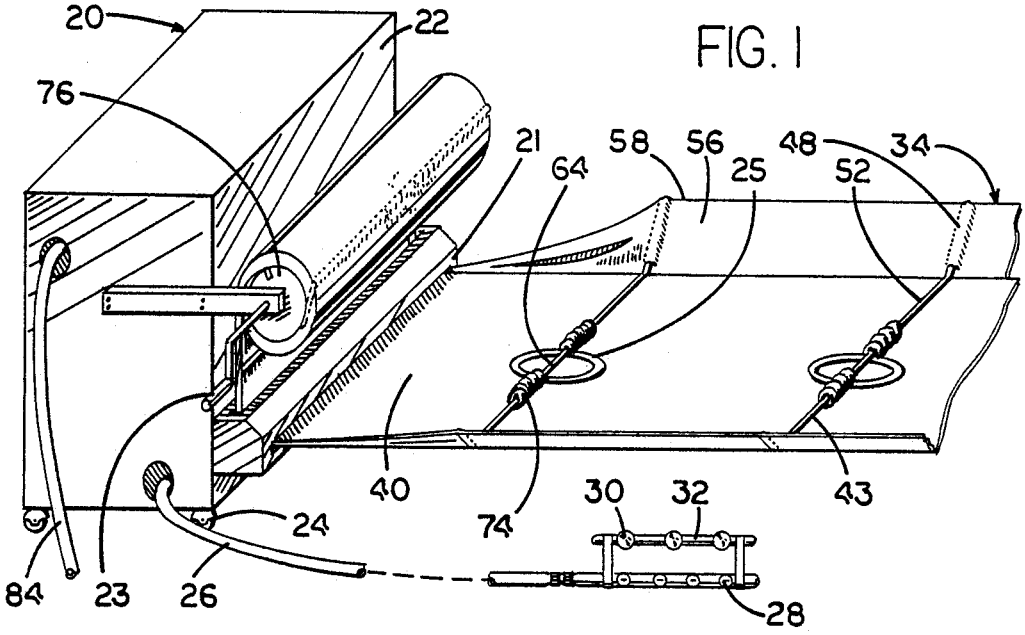
FIG. 1 is a schematic view of the invention.

Referring to FIG. 1 there is seen generally, a storable water curtain sanding aid system 20 according to the invention. Support body 22, mounted on wheels 24 for easy relocation about the work area, includes curtain supply hose 26, having adjustable distribution spigots 28 at its distal end, which is attached to a surface to be wetted by suction cups 30 of flexible support frame 32. The support body may take the form of a frame, dolly, or it may comprise a housing, as shown in FIGS. 1, 3, 10 and 12.

Catch tray 34 progressively extends from squeegee 21. Made from a tough grade of synthetic rubber, plastic, or similar flexible waterproof material, catch tray 34 includes side walls 56 which creasingly fold when the tray is temporarily stored on take-up roll 76 that is mounted outside the housing. Wind up storage on the roll is facilitated by hand crank 23.

Figure 2:
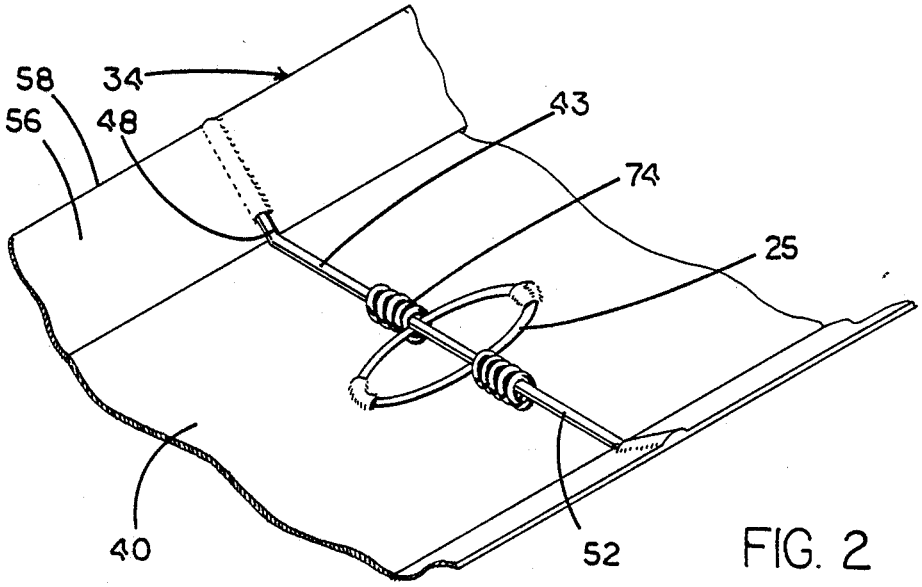
FIG. 2 is a view of a tray of the invention.

That portion of tray 34 which is extended to a position under the work surface to be wetted, is automatically unfolded into the erect tray shape shown, as it is hand-drawn out through squeegee 21 by pulling at its end. Erection is accomplished by the aid of tray bottom mounted erection pivot 25 and spring-like U frame 43. The erection pivot is provided to bias the frame and therewith the tray's side walls 56 into an erect postion. Erection pivot 25, generally in loop or tab form, and preferebly comprising two loops or tabs, is fastened by them to the tray floor (FIG. 2) by bonding or other suitable means. U frame 43 and biased erection pivot 25 provide tray erection support at the middle of successive cross sectional elements of the trough. The cross sectional elements are defined by vertical frame sections 48 and bottom frame section 52. Vertical frame sections 48 are preferably angled at 45 degrees to the bottom frame section, although not necessarily so, as may be seen in later described embodiments.

Vertical frame sections 48 and bottom frame sections 52 are joined with the tray's side walls 56 and bottom 40 by conventional means such as by containment molding within the tray substance, or attachment to it by straps or integral loops or tubes. It is preferred that the so-joined frame sections have liberty to slide and to rotate, with respect to the side wall or bottom to which they are joined, in order to minimize resistance to fold and unfold movements of the tray walls and bottom.

When stored on take-up roll 76, outside support body 22, tray 34 is in collapsed state, with the U frame's vertical sections positioned down, generally aligned with the tray's bottom around the circumference of the take up roll.

Figure 8A:
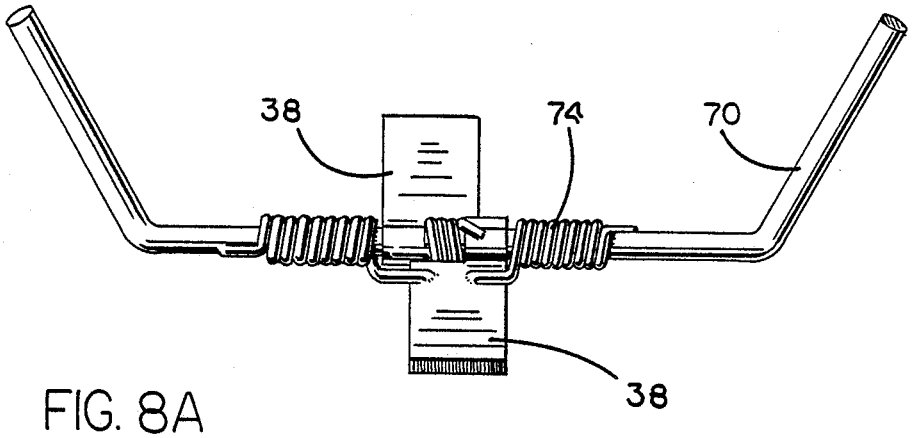

Spring 74, FIG. 8A, attached to erection pivot 25 and bottom frame section 52, receives a rotational biasing force from the vertical sections by way of the bottom frame section when they are positioned down as the tray is wrapped around roll 76. Spring 74 comprises two clockwise and one counterclockwise coil spring braised between the bottom frame and tabs 38. Alternatively, erection pivot may comprise loops, tabs or lobes in cooperation with one or more springs, brazed spring finger-like extensions, or other means known to the resilient biasing art with respect to the bottom frame and fastened to the tray bottom.

When the tray is drawn out for deployment under a work surface, it is pulled from take-up roll 76 by way of squeegee 21. As it leaves the confinement of the squeegee, erection pivot 25, in conjunction with coil spring 74, applies the rotational force received by the spring during storage, to the bottom frame section, thereby forcing the vertical frame sections to an erect position.

In another embodiment shown in FIG. 3, housing 22, supported on wheels 24, includes curtain supply hose 26, having adjustable distribution spigots 28 at its distal end, which is attached to a surface to be wetted by suction cups 30 of flexible support frame 32. Catch tray 34 progressively extends from guide slot 36. Made from a tough grade of synthetic rubber, or the like, catch tray 34 includes side walls 56 which creasingly fold against tray bottom 40 in the portion of the tray that is temporarily roll-stored (not shown) within housing 22. The portion of tray 34 which is to be extended to the region under the surface to be wetted, is automatically unfolded and forced into the tray shape shown, as it is drawn out from guide slot 36. Erection is established by the aid of erection pivot 42 and spring-like rectangular frame 44. The erection pivot, generally in the form of a loop, provides support at the middle of successive cross sectional elements of the trough. The cross sectional elements in this embodiment are defined by vertical frame sections 48, top frame section 50, and bottom frame section 52.

Vertical frame sections 48 and bottom frame sections 52 are joined with the tray's side walls and bottom by conventional means such as by containment molding within the frame substance, or attachment to it by straps or integral loops or tubes. As explained earlier, it is preferred that the frame sections have liberty to slide and to rotate with respect to the side wall or bottom, which they are joined.

An erection pivot is operated by self-contained spring action, or it may be cammed into its tray erection support position.

In the embodiment shown in FIGS. 3, 4 and 5, erection pivot 42 is in the form of an elongated flexible wire loop which, although it is stiff enough to hold the tray sides vertical in conjunction with vertical frame sections 48, it will yield to bending forces encountered when the tray is rolled up in housing 22. The erection pivot is held by, and rotates about, top frame section 50, cammed into its vertical position by fold shield 54 as its associated frame passes out through guide slot 36 and it comes into interference with fold shield 54.

While in storage (not shown) within housing 22, tray 34 is in collapsed state and wound, on a take-up reel that is similar to reel 76 shown in FIG. 6 and described later, with rectangular frame's vertical frame sections and erection pivot 42 positioned down along the tray bottom along with tray side walls 56 and top edges 58. Those edges tend to pleat when so folded down.

Although inclusion of successive rectangular frames and a erection pivot is preferred, it is also within the contemplation of the invention to have the frames, rectangular or otherwise, provide support without inclusion of erection pivots, or to have the tray made from material that is tough and resilient enough to support itself in tray form when not forceably folded or rolled into compact storage.

During its withdrawal from housing 22 by way of guide slot 36, the tray's side walls tend by their natural resiliency to unfold slightly, and upper portion 60 of the erection pivot tends to lift, as its pivot axis 64 lifts with the tray's top edges 58. Upper portion 60 of the erection pivot then comes into contact with fold shield 54, shown as a dihedral, but which can be a rubber roller, stiff paddle, inclined or contoured surface or other protrusion from the housing. Prior to pivot contact with the fold shield, the pivot top portion leads the pivot axis. Fold shield 54, however retards progress of the pivot upper portion so that the continuing movement of top frame section 58 draws the pivot point under the fold shield, bringing lower portion 62 of the pivot under the top portion, whereby the pivot tends to fold at its pivot point and becomes a biased spring. As the pivot point passes the fold shield, with the pivot top portion behind, under influence of the shield, its lower portion 62 sprigs slidingly against the tray bottom 40, until its lower end comes to a stop within cam stop 68 that is located on the tray bottom, and continuing to spring back to a straight shape, lower portion 62, bearing on the tray bottom by way of cam stop 68, urges tray top edges upward, and with them, tray side walls 56 into erect status. The upper portion of the erection pivot, about this time, leaves influence of the fold shield and springs vertical.

Erection pivot 42 shown in FIGS. 3, 4, and 5, pivots freely about top frame section 50, and rotates to the vertical by aid of cam stop 68.

Erection pivot 42, shown in FIG. 7A, tends to stop at the vertical owing to flexible horizontal dual support rods 70. This pivot operates without a fold shield, as its at-rest position is the vertical.

Erection pivot 42 shown in FIG. 8B obtains its at-rest vertical position from coil springs 74.

The pivot's fold-down, FIG. 6, is accomplished by a fold shield or, without a shield, is accomplished by the combination of being forced over by underside 72 of the tray, and then laid down proximate to tray bottom 40, as the tray is wrapped on take-up roll 76, drawn around by attachment point 78 on the roll.

FIG. 7B shows a shortened erection pivot. With lower portion 62 eliminated, it serves as a contact surface for receiving fold-down force from a fold shield or encountered during wrap up of the tray.

Both side walls are forced down toward the tray bottom as they and the top frame section, come into contact with the earlier stored portion of the tray. In the tray having no frame section, consecutive layers may have both sides of the tray pressed down or, each layer can be shifted slightly from the earlier so that side walls on one side nest, while those on the other side of the tray are pressed down.

FIG. 9 shows catch tray 34 deployed under a car's rear door panel outer surface represented by line 80, for catching water delivered to the panel during sanding, by the invention's adjustable distribution spigots 28, which are positioned outboard to the panel by support frame 32 (not shown), and also for catching the particulate matter resulting from sanding the panel surface. Tray side walls 56 and its bottom 40 have sufficient flexibility to allow large radius bends, similar to the one around car wheel 82 shown in FIG. 9. Retrieval hose 84 attaches to the tray for withdrawing water and sanding sludge for filtration in housing 22.

As may be seen in FIG. 10, depicting a partial view of the sanding aid system without the tray and take-up roll, withdrawal is effected, as in FIG. 10, by wet suction pump 86 of the type known to the pump art, and gravity feed of the water 89 through sludge filter tray 88, to a lower chamber 91 where it is pumped out by delivery pump 90, through curtain supply hose 26. This is preferable to employing the suction of the delivery pump alone to draw all the way back to the retrieval hose, due to flow resistance of the particulate matter sludge 92 which collects on filter tray 88. Venting and overflow are controlled by means known to the hydraulic art.

Catch trays 34 shown in FIG. 11, include sidewalls 56 that are self-supporting and which have flexible portions 94 for forming them to conform to fit under an irregularly contoured work surface, so that top edges 58 of the trays stand forward and back of the work surface for most efficient water collection. When, however it is not possible to straddle both front and back of the work surface, flexible shield 96 is used. The shield may be made long enough for location along only a portion of the tray's length, or it entire length, as desired.

The shield may be attached to the inboard side of the tray's side wall at the tray's top edge 58 with snaps 98 or made as part of the tray's top edge with, for example, a living hinge 100 attachment. The top of the shield is attached behind the work surface by magnets, clips or other conventional means. Elastic top 102 provides shield attachment to the upper portion of vehicle wheel 82. Water which would be lost to the tray by splashing from the sanding block, the operator's hand, or by following a downward and inward lower curve of the vehicle's panel to a location not over the tray, is caught by the shield and delivered by it to the tray.

Flexible coupling 104 between trays, provides option for further tray orientation. Retrieval hose 84 attaches through quick disconnect 106 to one catch tray 34 of the two, for removing water and particulate matter sludge, as explained earlier. When work is done, the trays are disconnected at flexible coupling 104 and quick disconnect 106, and stored away. They are made in different widths and lengths for nesting in storage.

Storable water sanding aid system 20 is seen, FIG. 12, wetting down the rear door panel of a car at the start of a sanding session. Suction cups 30 position support frame 32 above the work area, although it should be understood that other attachments such as hooks, clamps or magnetic grips may be used to position the support frame.

It should be understood that the present invention may be embodied in other specific forms without departing from the spirit of the invention. For example, the take-up roll 76 and fold shield 54 may be located external to the housing, or the system may be mounted on an open frame with ready access to the filter's upper surface for overnight drying and easy morning removal of the sludge.

The above invention having been described in various embodiments, and not limited to them, reference should be made to the appended claims for the scope of the invention.

What is claimed is:

1. A storable water curtain sanding aid system for use in conjunction with a work surface, said system comprising:

spigot means for delivering a liquid, means for holding said spigot means in desired relationship to a work surface, a tray for collecting the liquid from said spigot means as well as particulate matter resulting from working on said work surface, a support body, storage means held by said support body, connected to one end of the tray, for storing the tray, said tray comprising a bottom and side walls which include top edges, said side walls being substantially vertical with respect to the bottom of a portion of the tray that is positioned for collecting, and at least one edge of a portion of the tray that is in storage being proximate to the tray bottom.

2. The invention as described in claim 1, said tray further comprising:

a plurality of tray frames comprising vertical frame sections, said vertical frame sections being joined with the tray side walls so that they are vertical with respect to the tray bottom when the side walls are vertical with respect to the tray bottom.

3. The invention as described in claim 2, said tray further comprising:

an erection pivot, mounted on said tray frame for biasing the vertical frame sections into an erect position.

4. The invention as described in claim 3, said frame further comprising:

a bottom tray frame section joined with the tray bottom, said erection pivot being mounted on said bottom frame section, resilient means for biasing, attached to said bottom mounted erection pivot, said tray bottom and said bottom frame section for urging said vertical frame section into a vertical position.

5. The invention as described in claim 4, further comprising:

chamber means held by said support body for holding water, retrieval ducting means, connected to said tray and to said chamber means for delivering water collected in said tray to the chamber means.

6. The invention as described in claim 5, further comprising:

filter means for separating solids from liquids, so located between said retrieval ducting means and said chamber means so that said filter means separates solids from liquid delivered by the retrieval ducting means to the chamber means.

7. The invention as described in claim 6, further comprising:

supply ducting means, connected to said chamber means for delivering filtered water to said spigot means.

8. The invention as described in claim 7, said means for holding said spigots further comprising:

a flexible support frame for holding said spigots, and means for attaching said flexible support frame to a surface, said means for attaching are adapted for attachment to an irregular surface, and said spigots being adjustable for directing liquid along said work surface.

9. A storable water curtain sanding aid system for use in conjunction with a work surface, said system comprising:

spigot means for delivering a liquid, means for holding said spigot means in desired relationship to a work surface, a tray for collecting the liquid from said spigot means as well as particulate matter resulting from working said surface, a support body, filter means for separating solids from liquids, mounted on said support body, retrieval ducting means, connected to said tray and to said support body for delivering liquid and particulate matter from said tray to said filter, supply ducting means for delivering liquid from said filter to said spigot means, means for moving said liquid and particulate matter collected within the tray, through the retrieval ducting means, to the filter means, and liquid from said filter means, through said supply ducting means, to said spigot means, and storage means on said support body, connected to one end of the tray, for storing the tray on said support body.

10. The invention as described in claim 9, said tray further comprising:

a bottom and side walls which include top edges, said side walls being substantially vertical with respect to the bottom of a portion of the tray that is positioned for collecting, and at least one edge of a portion of the tray that is in storage being proximate to the tray bottom.

11. The invention as described in claim 10, said tray further comprising:

a plurality of frames comprising vertical and top frame sections, said vertical frame sections being joined with the tray side walls so that they are vertical, with respect to the tray bottom, when the side walls are vertical with respect to the tray bottom.

12. The invention as described in claim 11, said tray further comprising:

an erection pivot, mounted on said top frame section for biasing the vertical frame section into an erect position.

13. The invention as described in claim 12, further comprising:

said erection pivot, including an upper portion said upper portion including an end, a lower portion said lower portion including an end, and a pivot axis, said erection pivot being mounted on said top frame section for rotation about said pivot axis, and said pivot axis being so located on the erection pivot so that said lower portion end bears on the tray bottom, for urging the side walls by way of said top frame section to a vertical status with respect to the tray bottom.

14. The invention as described in claim 13, further comprising:

resilient means, connected to the erection pivot and to the tray for resisting rotation of said erection pivot from a perpendicular status.

15. The invention as described in claim 14, further comprising:

a cam stop, located on the tray bottom for resisting rotation of the erection pivot substantially through the perpendicular status, and a fold shield, mounted on the support body, for engaging the status pivot's upper portion, for urging said pivot into rotation toward the perpendicular status during storing of the tray on the frame.

16. The invention as described in claim 11, said means for holding said spigots further comprising:

a flexible support frame for holding said spigots, and means for attaching said support frame to a surface, said means for attaching are adapted for attachment to an irregular surface, and said spigots being adjustable for directing liquid along said work surface.

17. A storable tray system comprising:

a tray including a bottom and side walls which include top edges, a support body, storage means on said support body, connected to one end of the tray, for storing the tray on said support body, at least one edge of a portion of the tray that is in storage being proximate to the tray bottom, and said side walls being vertical with respect to the bottom of a portion of the tray that is out of storage, a plurality of frames comprising vertical and top frame sections, said vertical frame sections being joined with the tray side walls so that they are substantially perpendicular to the tray bottom when the side walls are substantially perpendicular to the tray bottom.

18. The invention described in claim 17, further comprising:

an erection pivot, mounted on said top frame section.

19. The invention described in claim 18, further comprising:

said erection pivot, including an upper portion said upper portion including an end and said erection pivot further including a pivot axis, and a lower portion, said lower portion including an end, said erection pivot being mounted on said top frame section for rotation about said pivot axis, and said pivot axis being so located on the erection pivot so that said lower portion end bears on the tray bottom, for urging the side walls by way of said top frame section to a substantially perpendicular position with respect to the tray bottom, resilient means, connected to the erection pivot and to the tray, for resisting rotation of said erection pivot from a perpendicular status.

20. The invention as described in claim 19, further comprising:

a cam stop, located on the tray bottom for resisting rotation of the erection pivot substantially through the perpendicular position, and a fold shield, mounted on the support body, for engaging the position pivot upper portion, for urging said pivot into rotation toward the perpendicular status during storing of the tray on the frame.

21. The invention as described in claim 9, further comprising:

said tray including a flexible portion for forming it to receive said liquid and particulate matter from an irregularly contoured work surface.

22. The invention as described in claim 21, further comprising:

said tray including flexible shield means, and means for attaching said flexible shield means in association with said work surface for interception of liquid from said work surface.

23. The invention as described in claim 22, further comprising:

said means for attaching said shield means including elastic portions for attaching said shield to elements connected with said work surface.

24. The invention as described in claims 21 or 22, further comprising:

said tray is a first tray, said first tray including flexible coupling means for connection with a second tray, said flexible coupling means is located on the first and second trays so that water can flow rom the second tray to the first tray for removal by said retrieval ducting means.

* * * * *